US011752064B2

(12) United States Patent
Coleman et al.

(10) Patent No.: US 11,752,064 B2
(45) Date of Patent: Sep. 12, 2023

(54) CONSTRAINED AND REPOSITIONABLE PERCUSSIVE MASSAGE DEVICE TOOL AND TOOL RECEIVER

(71) Applicant: PlayMakar Inc., Fort Worth, TX (US)

(72) Inventors: Wesley A. Coleman, N. Richland Hills, TX (US); Michael James Williams, Colleyville, TX (US); Federico G. Vierheller, Fort Worth, TX (US)

(73) Assignee: PlayMakar, Inc., Fort Worth, TX (US)

( * ) Notice: Subject to any disclaimer, the term of this patent is extended or adjusted under 35 U.S.C. 154(b) by 0 days.

(21) Appl. No.: 17/508,954

(22) Filed: Oct. 22, 2021

(65) Prior Publication Data

US 2022/0168176 A1 Jun. 2, 2022

Related U.S. Application Data

(60) Provisional application No. 63/164,278, filed on Mar. 22, 2021, provisional application No. 63/120,502, filed on Dec. 2, 2020.

(51) Int. Cl.
*A61H 23/00* (2006.01)
*A61H 23/02* (2006.01)

(52) U.S. Cl.
CPC ..... *A61H 23/006* (2013.01); *A61H 23/0263* (2013.01); *A61H 2201/0153* (2013.01);
(Continued)

(58) Field of Classification Search
CPC ..... A61H 23/006; A61H 23/0263; A61H 2201/0153; A61H 2201/1215;
(Continued)

(56) References Cited

U.S. PATENT DOCUMENTS 859,424 A 7/1907 Aschburner
890,822 A 6/1908 Tourtel et al.
(Continued)

FOREIGN PATENT DOCUMENTS

CH 388531 A 2/1965
CN 2694966 Y 4/2005
(Continued)

OTHER PUBLICATIONS

English translation for CH388531, espacenet.com, translated on Jul. 8, 2021.

(Continued)

*Primary Examiner* — Quang D Thanh
(74) *Attorney, Agent, or Firm* — Dawn-Marie Bey; Bey & Cotropia PLLC

(57) ABSTRACT

A percussive massaging device has a base which includes a tool receiver and a piston for providing percussive action to a massage tool. The massage tool includes an attachment for selectively attaching to the tool receiver using one of a key and keyway system and a magnetic system. The attachment post further includes a press-fit seal or a magnetic mechanism for further securing the attachment post to the tool receiver. The massage tool further includes a tool head which may be non-rotating or is capable of rotating in one or more directions during use while simultaneously providing a percussive massage to a user.

19 Claims, 17 Drawing Sheets

(52) U.S. Cl.
CPC ..... *A61H 2201/1215* (2013.01); *A61H 2201/1669* (2013.01); *A61H 2201/1671* (2013.01)

(58) Field of Classification Search
CPC .... A61H 2201/1669; A61H 2201/1671; A61H 1/00; A61H 23/02; A61H 2201/0157; A61H 2201/123
See application file for complete search history.

(56) References Cited

U.S. PATENT DOCUMENTS

| | | | | |
|---|---|---|---|---|
| 1,368,782 | A | 2/1921 | Beach | |
| 2,122,556 | A | 7/1938 | Buffalow | |
| 2,156,839 | A | 5/1939 | Buffalow | |
| 4,088,128 | A | 5/1978 | Mabuchi | |
| 4,513,737 | A | 4/1985 | Mabuchi | |
| 4,549,535 | A | 10/1985 | Wing | |
| D284,553 | S | 7/1986 | Collister | |
| 4,726,369 | A | 2/1988 | Mar | |
| 4,726,430 | A | 2/1988 | Hendrikx et al. | |
| 4,790,296 | A | 12/1988 | Segal | |
| 4,841,955 | A | 6/1989 | Evans et al. | |
| 5,085,207 | A | 2/1992 | Fiore | |
| 5,134,777 | A | 8/1992 | Meyer | |
| D373,571 | S | 9/1996 | Zambelli | |
| 5,656,017 | A | 8/1997 | Keller et al. | |
| 5,690,608 | A | 11/1997 | Watanabe et al. | |
| 5,697,268 | A | 12/1997 | Makovsky | |
| 5,730,044 | A | 3/1998 | Oh | |
| D434,291 | S | 11/2000 | Kim | |
| 6,228,042 | B1 | 5/2001 | Dungan | |
| 6,357,125 | B1 | 3/2002 | Feldmann | |
| 6,616,621 | B1 | 9/2003 | Kohr | |
| 6,682,496 | B1 | 1/2004 | Pivaroff | |
| 6,758,826 | B2 | 7/2004 | Luettgen et al. | |
| D525,115 | S | 7/2006 | Harwanko | |
| 7,122,013 | B2 | 10/2006 | Liu | |
| 7,144,417 | B2 | 12/2006 | Colloca et al. | |
| D544,102 | S | 6/2007 | Pivaroff | |
| D578,080 | S | 10/2008 | Whang | |
| 7,503,923 | B2 | 3/2009 | Miller | |
| D607,852 | S | 1/2010 | Steven | |
| D631,073 | S | 1/2011 | Papa | |
| D632,265 | S | 2/2011 | Choi | |
| D639,784 | S | 6/2011 | Murayama | |
| D649,657 | S | 11/2011 | Petersen et al. | |
| 8,083,699 | B2 | 12/2011 | Colloca et al. | |
| D662,398 | S | 6/2012 | Jahnke | |
| D679,576 | S | 4/2013 | Paul | |
| 8,826,547 | B2 | 9/2014 | Oberheim | |
| 8,968,221 | B2 | 3/2015 | Pryor et al. | |
| D738,355 | S | 9/2015 | Smith | |
| D751,538 | S | 3/2016 | Koehler | |
| D756,333 | S | 5/2016 | Smith | |
| 9,526,671 | B2 | 12/2016 | Weck et al. | |
| D781,674 | S | 3/2017 | Bullard | |
| 9,889,066 | B2 | 2/2018 | Danby et al. | |
| D826,205 | S | 8/2018 | Langhammer | |
| D837,395 | S | 1/2019 | Gan | |
| D840,355 | S | 2/2019 | Simon | |
| D848,398 | S | 5/2019 | Huang | |
| D849,260 | S | 5/2019 | Wersland | |
| D850,639 | S | 6/2019 | Wersland | |
| D850,640 | S | 6/2019 | Wersland | |
| 10,314,762 | B1 | 6/2019 | Marton et al. | |
| 10,357,425 | B2 | 7/2019 | Wersland et al. | |
| D855,822 | S | 8/2019 | Marton | |
| D857,650 | S | 8/2019 | Hardi | |
| D859,680 | S | 9/2019 | Wersland | |
| D867,342 | S | 11/2019 | Afshar Bakooshli | |
| 10,485,731 | B2 | 11/2019 | Babiuk | |
| 10,492,984 | B2 | 12/2019 | Marton et al. | |
| D873,432 | S | 1/2020 | Duan | |
| D874,015 | S | 1/2020 | Marton | |
| 10,561,574 | B1 | 2/2020 | Marton et al. | |
| D882,785 | S | 4/2020 | Qun | |
| D886,317 | S | 6/2020 | Marton | |
| D890,353 | S | 7/2020 | Nazarian | |
| D890,942 | S | 7/2020 | Wersland | |
| D890,943 | S | 7/2020 | Wersland | |
| 10,702,448 | B2 | 7/2020 | Wersland et al. | |
| D893,738 | S | 8/2020 | Zhuang | |
| D895,133 | S | 9/2020 | Xu | |
| D895,135 | S | 9/2020 | Xu | |
| D895,402 | S | 9/2020 | Hung | |
| D895,828 | S | 9/2020 | Marshall | |
| D895,831 | S | 9/2020 | Chen | |
| D896,393 | S | 9/2020 | Wersland | |
| D898,933 | S | 10/2020 | Xu | |
| D905,863 | S | 12/2020 | Lin | |
| D906,533 | S | 12/2020 | Lijun | |
| D907,792 | S | 1/2021 | Marton et al. | |
| D908,235 | S | 1/2021 | Marton et al. | |
| D910,870 | S | 2/2021 | Marton | |
| D917,060 | S | 4/2021 | Hu | |
| D918,404 | S | 5/2021 | Wersland | |
| D918,405 | S | 5/2021 | Wersland | |
| D918,408 | S | 5/2021 | Huang | |
| 10,993,874 | B1 | 5/2021 | Marton et al. | |
| D920,944 | S | 6/2021 | Paterson | |
| D924,422 | S | 7/2021 | Huang | |
| D927,716 | S | 8/2021 | Wersland | |
| D927,717 | S | 8/2021 | Wersland | |
| D931,492 | S | 9/2021 | Li | |
| D935,403 | S | 11/2021 | Wu | |
| D935,404 | S | 11/2021 | Wu | |
| D938,056 | S | 12/2021 | Wu | |
| D940,892 | S | 1/2022 | Shen | |
| D941,145 | S | 1/2022 | Wang | |
| 11,253,423 | B1 | 2/2022 | Williams | |
| D949,365 | S | 4/2022 | Li | |
| D949,366 | S | 4/2022 | Li | |
| D949,384 | S | 4/2022 | Liang | |
| D949,417 | S | 4/2022 | Khubani | |
| D949,418 | S | 4/2022 | Khubani | |
| D952,878 | S | 5/2022 | Lin | |
| D958,654 | S | 7/2022 | Lupberger | |
| D959,268 | S | 8/2022 | Hume | |
| D961,107 | S | 8/2022 | Tian | |
| D961,795 | S | 8/2022 | Zhao | |
| 11,452,665 | B1 | 9/2022 | Yu | |
| D967,971 | S | 10/2022 | Jinfeng | |
| 11,478,400 | B1 | 10/2022 | Marton | |
| 11,497,676 | B2 | 11/2022 | Liu | |
| 2002/0082532 | A1 | 6/2002 | Tucek et al. | |
| 2002/0107459 | A1 | 8/2002 | Chang | |
| 2003/0009116 | A1* | 1/2003 | Luettgen ..... | A61H 19/34 601/72 |
| 2003/0009118 | A1 | 1/2003 | Sabo | |
| 2003/0028134 | A1 | 2/2003 | Lev | |
| 2003/0040689 | A1 | 2/2003 | Chan et al. | |
| 2003/0101847 | A1 | 6/2003 | Harimoto | |
| 2003/0195443 | A1 | 10/2003 | Miller | |
| 2005/0109137 | A1 | 5/2005 | Hartmann | |
| 2005/0113870 | A1* | 5/2005 | Miller ..... | A61H 1/008 606/237 |
| 2005/0131461 | A1 | 6/2005 | Tucek et al. | |
| 2006/0025710 | A1 | 2/2006 | Schulz et al. | |
| 2006/0293711 | A1 | 12/2006 | Keller et al. | |
| 2008/0014011 | A1 | 1/2008 | Rossen | |
| 2008/0183252 | A1 | 7/2008 | Khen | |
| 2009/0270915 | A1 | 10/2009 | Tsai et al. | |
| 2010/0137907 | A1 | 6/2010 | Tsai | |
| 2011/0056339 | A1 | 3/2011 | Su | |
| 2014/0031866 | A1 | 1/2014 | Fuhr et al. | |
| 2014/0234146 | A1 | 8/2014 | Pattakos | |
| 2015/0005682 | A1 | 1/2015 | Danby et al. | |
| 2015/0107383 | A1 | 4/2015 | Duesselberg et al. | |
| 2015/0182415 | A1 | 7/2015 | Olkowski et al. | |
| 2016/0354277 | A1* | 12/2016 | Fima ..... | A61H 19/44 |
| 2016/0367425 | A1 | 12/2016 | Wersland | |
| 2017/0001290 | A1 | 1/2017 | Liu | |
| 2017/0304145 | A1 | 10/2017 | Pepe | |

(56) References Cited

U.S. PATENT DOCUMENTS

| | | | |
|---|---|---|---|
| 2018/0008512 | A1 | 1/2018 | Goldstein |
| 2018/0168913 | A1 | 6/2018 | Sedic |
| 2018/0200141 | A1 | 7/2018 | Wersland et al. |
| 2018/0263845 | A1 | 9/2018 | Wersland et al. |
| 2018/0320732 | A1 | 11/2018 | Kim |
| 2018/0353369 | A1 | 12/2018 | Newns et al. |
| 2019/0015294 | A1 | 1/2019 | Nazarian et al. |
| 2019/0175434 | A1 | 6/2019 | Zhang |
| 2019/0209424 | A1 | 7/2019 | Wersland et al. |
| 2019/0232403 | A1 | 8/2019 | Candelaria |
| 2019/0254921 | A1 | 8/2019 | Marton et al. |
| 2019/0350793 | A1* | 11/2019 | Wersland ..... A61H 23/006 |
| 2019/0365598 | A1 | 12/2019 | Qu |
| 2020/0046598 | A1 | 2/2020 | Shen |
| 2020/0046604 | A1* | 2/2020 | Danby ..... A61H 23/0254 |
| 2020/0085675 | A1 | 3/2020 | Lee et al. |
| 2020/0110526 | A1 | 4/2020 | Ano et al. |
| 2020/0170871 | A1 | 6/2020 | Lukinuk et al. |
| 2020/0214930 | A1* | 7/2020 | Wersland ..... A61H 1/00 |
| 2020/0261307 | A1 | 8/2020 | Wersland et al. |
| 2020/0261310 | A1 | 8/2020 | Wersland et al. |
| 2020/0268594 | A1 | 8/2020 | Pepe |
| 2020/0276079 | A1 | 9/2020 | Cheng |
| 2020/0289365 | A1 | 9/2020 | Wersland et al. |
| 2020/0330321 | A1 | 10/2020 | Wersland et al. |
| 2020/0352820 | A1 | 11/2020 | Nazarian et al. |
| 2020/0352821 | A1 | 11/2020 | Wersland et al. |
| 2020/0390644 | A1 | 12/2020 | Yang |
| 2020/0393026 | A1 | 12/2020 | Chang |
| 2020/0405574 | A1 | 12/2020 | Wersland et al. |
| 2021/0003168 | A1 | 1/2021 | Cong |
| 2021/0022951 | A1 | 1/2021 | Hu |
| 2021/0022955 | A1 | 1/2021 | Wersland |
| 2021/0059898 | A1 | 3/2021 | Wersland et al. |
| 2021/0113421 | A1 | 4/2021 | Chuang |
| 2021/0128402 | A1 | 5/2021 | Dai et al. |
| 2021/0137779 | A1 | 5/2021 | Ayu et al. |
| 2021/0196562 | A1 | 7/2021 | Zhao |
| 2021/0244610 | A1 | 8/2021 | Wersland et al. |
| 2021/0322257 | A1 | 10/2021 | Lee |
| 2021/0369549 | A1 | 12/2021 | Almodovar |
| 2022/0096320 | A1 | 3/2022 | Lu |
| 2022/0154764 | A1 | 5/2022 | Yamashita |
| 2022/0168175 | A1 | 6/2022 | Tang |
| 2022/0168177 | A1 | 6/2022 | Merheller |
| 2022/0211575 | A1 | 7/2022 | Wersland |

FOREIGN PATENT DOCUMENTS

| | | |
|---|---|---|
| CN | 202536467 U | 11/2012 |
| CN | 205268525 U | 6/2016 |
| CN | 206381369 U | 8/2017 |
| CN | 208130157 U | 11/2018 |
| CN | 306178047 | 11/2020 |
| CN | 212749648 U | 3/2021 |
| CN | 2020305792978 | 3/2021 |
| CN | 306489315 | 4/2021 |
| CN | 2021302494257 | 8/2021 |
| KR | 102249761 B1 | 5/2021 |
| TW | M511855 U | 11/2015 |
| TW | M543692 U | 6/2017 |
| TW | D207405 | 9/2020 |
| WO | WO 2022/149067 | 7/2022 |

OTHER PUBLICATIONS

English translation for CN 212749648 from Espaccnct on Jul. 18. 2022 (year 2021).

WEILEITE—Accumulator Piston Kit. Date: Aug. 24, 2021. [online] [Site visited Jan. 12, 2023]. Available from Internet URL: https://www.amazon.com/dp/B09J15G8V7/ (Year: 2021).

Youtube,, "ShoDuo Absorption & Reverberation Massage Head", Published Date: Sep. 26, 2022. https://www.youtube.com/ watch?v=OW6z6eYNo4o (Year: 2022).

Amazon.com; Massage Gun Massage Gun—Massage Pulse Mini Muscle Massage Gun; Apr. 28, 2022; 2 pgs.

AliExpress.com; Portable Massage Gun Deep Tissue Percussion Muscle Massager For Pain; retrieved on Nov. 22, 2022; 1 pg.

Amazon.com; Mebak 3 Massage Gun Muscle Massager Electric Hand Massager, May 22, 2020; 3 pgs.

Flyby—Massage gun. Date: Aug. 11, 2020. [online]. [Site visited Dec. 1, 2022]. Available from Internet URL: www youtube.com/ watch?v =GYvuNuif8Bc (Year: 2020).

Massage guns. (Design-©Questel) orbit.com. [Online PDF compilation of references selected by examiner] 50 pgs. Print Dates Range Apr. 28, 2020-Mar. 11, 2022 [Retrieved Dec. 2, 2022] https://www.orbit.com/export/UCZAH96B/pdf4/e6b9a3b3-195c-4fbe-87b2-0eaaf315609e-165234.pdf (Year: 2022).

HP Race Development—Titanium connecting rods. Date: Apr. 30, 2021. [online], [Site visited Dec. 15, 2022], Available from Internet URL: https://www.hpracedevelopment.com/news/titanium-connecting-rods-now-available-all-current-250f-models#/ (Year: 2021).

Massage Gun Deep Tissue, Percussion Muscle Massager Gun for Atnletes—Flyby F1 Pro—Handheld Neck & Back Massager for Pain Relief—Therapy and Relaxation Body Massager Gun—Lightweight (Black), [retrieved on Oct. 28, 2021], 9 pp.

Toloco Massage Gun, upgrade Percussion Muscle Massage Gun tor Athletes, Handheld Deep Tissue Massager Slack), [retrieved on Oct. 29, 2021], 10 pp., Retrieved from the Internet: https://www.amazon.com/TOLOCO-massage-Gun-Upgraded-Brushless/dp/B083L8RNJR/ref=sr_1_1 sspa?dchild=1&keywords=Massage%2Bgun&qid=1635272886&sr=8-1 -spons&spLa=ZW5jcnlwdGVkUXVhbGlmaWVyPUFETDEwSENOVDg4SzgmZW5jcnlwdGVkSWQ9QTAyOTUzNTMxN.

Massage Gun Deep Tissue, Muscle Percussion Back Neck Head Handheld Hammer Massager for Athletes, 30 speed Level, LED Touch Screen, Long Battery Life with 10 Heads, [retrieved on Oct. 29, 2021], 9 pp.

English translation for KR 102249761, translated by espacenet.com, translated on Oct. 31, 2022.

* cited by examiner

FRONT VIEW

CONSTRAINED AND REPOSITIONABLE PERCUSSIVE MASSAGE DEVICE TOOL AND TOOL RECEIVER

CROSS-REFERENCE TO RELATED APPLICATIONS

The present application claims priority to the following U.S. Provisional Application Ser. No. 63/164,278 filed Mar. 22, 2021 and Ser. No. 63/120,502 filed Dec. 2, 2020, which are incorporated herein by reference in their entireties.

The following applications are incorporated herein by reference in their entireties: U.S. patent application Ser. No. 17/223,840 entitled Percussive Massager Rotational Accessory, filed Apr. 6, 2021, and U.S. patent application Ser. No. 17/229,860 entitled Variable Stroke Percussive Massage Device, filed Apr. 13, 2021, both commonly owned and listing overlapping inventors.

FIELD OF THE INVENTION

This invention relates to massaging devices, and more particularly to a tool for a percussive massaging device which can be constrained and repositioned with a tool receiver portion of the massage device.

BACKGROUND

Vibratory or percussive massaging devices typically include a tool head that is adapted for contacting a person's skin and delivering a therapeutic effect thereto. But heretofore the movement of the tool head has been confined to one dimension, that is, forward and backward along a longitudinal axis of the tool head. Further, many massaging devices of the prior art include a tool head that is not easily directed to deliver a desired therapeutic effect to the person's skin along multiple dimensions and/or directions.

Therefore, there is a need for a tool head for a percussive massaging device that provides a therapeutic effect to the person's skin along multiple dimensions and directions. Such a needed invention would be easily interchanged with a tool head that provides a different therapeutic effect. Further, such a needed device would be relatively simple to manufacture and intuitive to use. The present invention accomplishes these objectives.

SUMMARY OF THE INVENTION

In a first exemplary embodiment, a percussive massaging device includes: a base, including a tool receiver for receiving a massage tool and a piston for providing percussive action to the massage tool; a massage tool, including an attachment post at a first end thereof for selectively attaching to the tool receiver, wherein the tool receiver includes multiple keyways and the attachment post includes multiple keys for engaging with at least some of the keyways to secure the massage tool to the base.

In a second exemplary embodiment, a percussive massaging device, includes: a base, including a tool receiver for receiving a massage tool and a piston for providing percussive action to the massage tool; a massage tool, including an attachment post at a first end thereof for selectively attaching to the tool receiver via a magnetic mechanism, wherein the magnetic mechanism includes a magnet located in the tool receiver and an insert formed of magnetically attracted material located on the attachment post.

DETAILED DESCRIPTION

Illustrative embodiments are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Figure 1A:
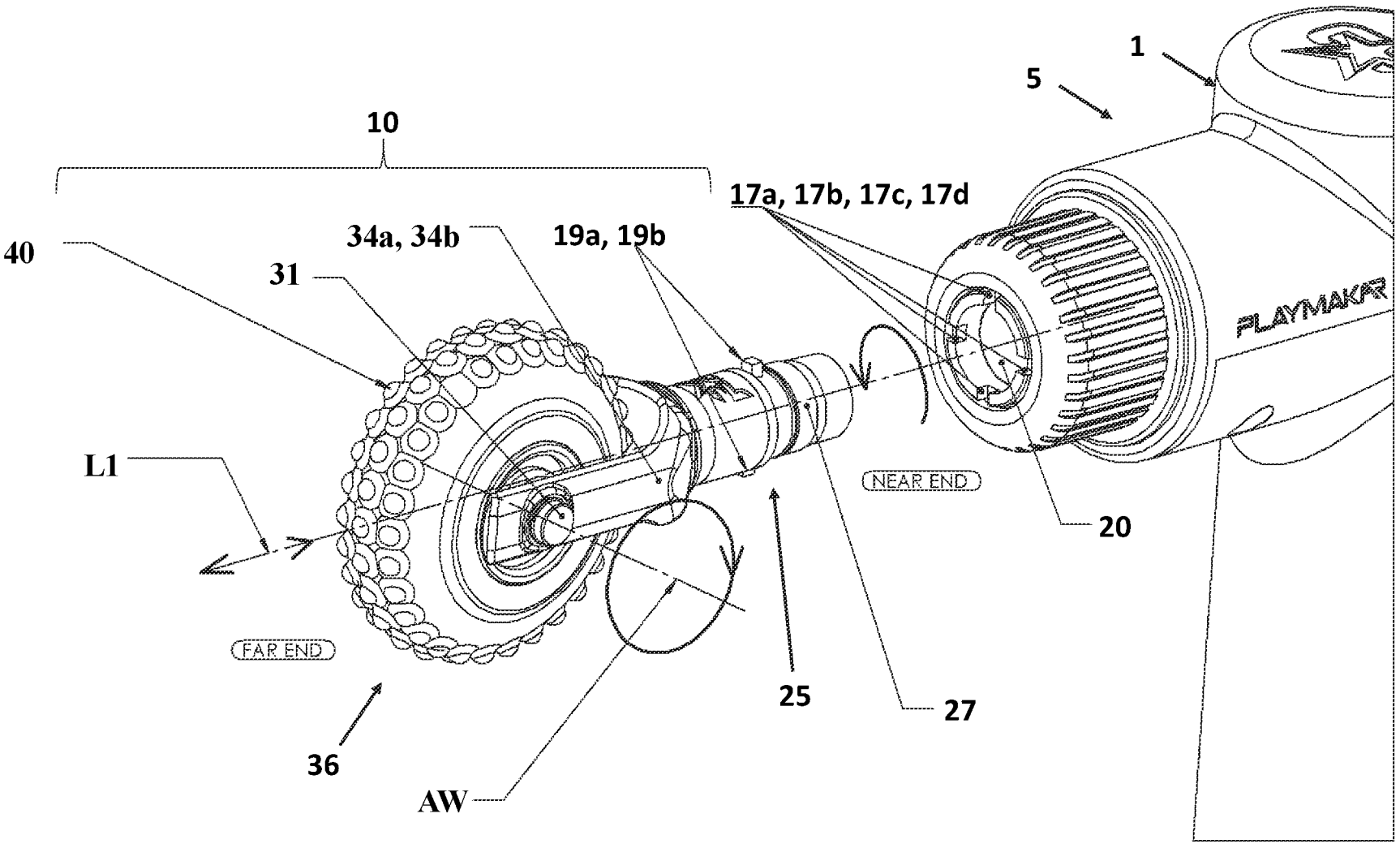
FIGS. 1*a* and 1*b* provide expanded views of a first and second exemplary configuration of a first tool and tool receiver of a massaging device according to one or more embodiments.
Figure 1B:
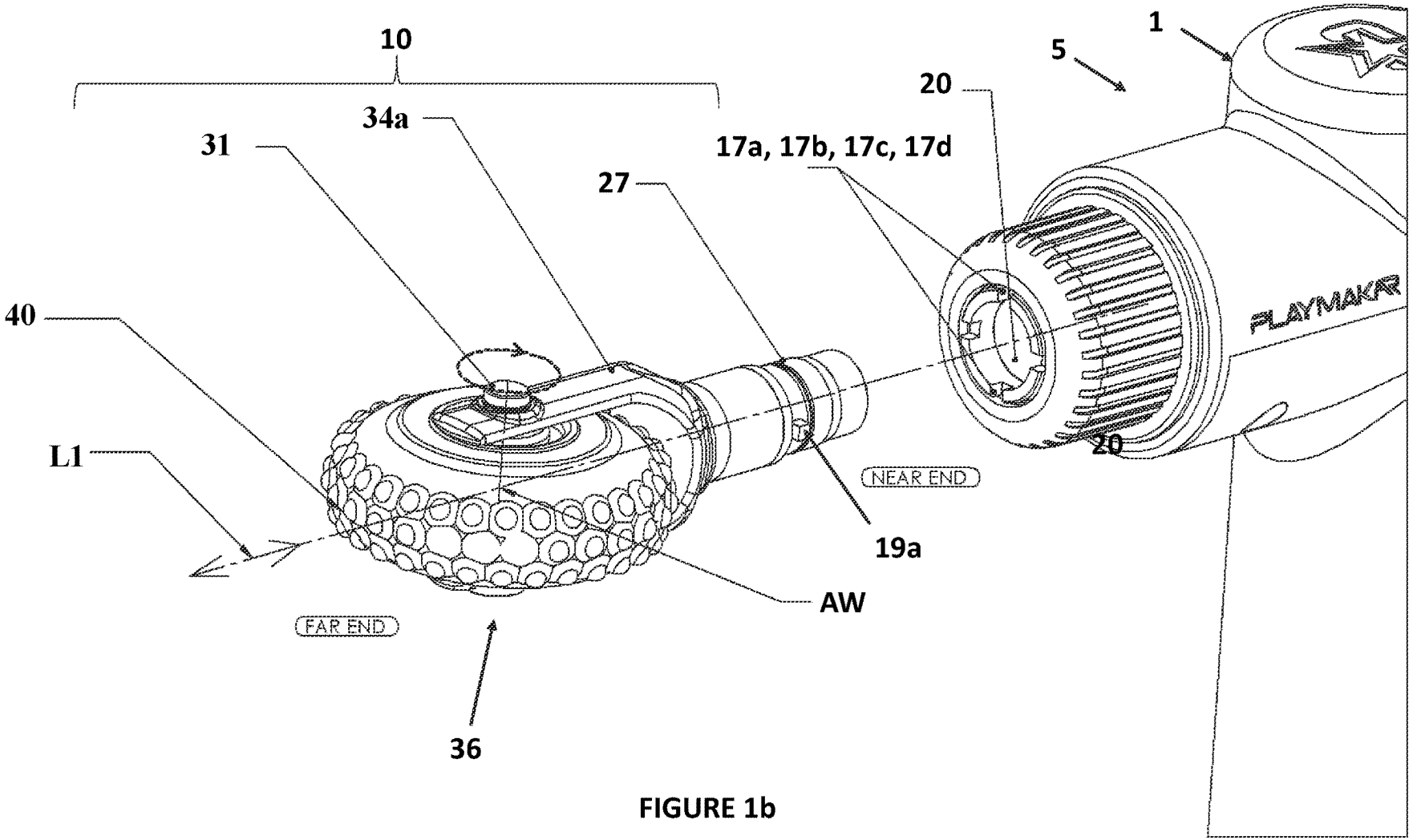

FIGS. 1*a* and 1*b* illustrates a first exemplary massage tool 10 for a percussive massaging device 5 that has a tool receiver 15. The tool comprises an attachment post 25 having a longitudinal axis L1 and that is adapted for selective attachment at a near end thereof with the tool receiver 15 of the percussive massaging device 5. In the present exemplary embodiment, the tool's attachment post 25 connects with the tool receiver 15 using a key and keyway configuration, wherein the tool receiver 15 includes multiple keyways, e.g., 17*a*, 17*b*, 17*c*, 17*d* which engaged with keys 19*a* and 19*b* on the tool's attachment post 25. In the preferred embodiment, there are four keyways, located at approximately positions 3, 6, 9 and 12 o-clock around the circumference of the approximately circular tool receiver. The attachment post keys engage with two keyways at a time to constrain the attachment post within the tool receiver. The attachment post 25 further includes a press-fit seal, e.g., elastomeric joint or Polyhedral seal 27, for ensuring secure engagement of the attachment post 25 with the tool receiver 15. This engagement facilitates the percussive massage driven by piston 20 of the percussive massaging device 5. One skilled in the art recognizes the additional exemplary specifications of the base 1 of the percussive massaging device which drive the piston. By way of example only, U.S.

patent application Ser. No. 17/229,860 entitled Variable Stroke Percussive Massage Device describes a system for supplying the percussive motion to the tool.

In FIG. 1*a*, the tool 10 is arranged in a first position when the two keys 19*a* and 19*b* engage with two keyways located opposite to one another within the entrance of the tool receiver 15. In FIG. 1*b*, the tool 10 is arranged in a second position when the two key 19*a* and 19*b* engage with the other two keyways located opposite to one another within the entrance of the tool receiver 15.

The first exemplary tool 10, further includes a tool head 30 which is rotatably fixed at a far end (e.g., distal end) of the attachment post 25 and has at least one skin-contacting surface 40. More particularly, the tool head 30 includes a fork 32 fixed at a first end thereof to the attachment post 25 and terminates at two opposing fork ends 34*a*, 34*b* at a second end thereof. A wheel 36 has the skin-contacting surface 40 and is rotationally mounted at opposing sides 38*a*, 38*b* (see FIG. 2*b*) thereof to the opposing distal fork ends 34*a*, 34*b* along a wheel axis 31. As such, the wheel 36 is free to rotate AW about the wheel axis along a person's skin as the wheel 36 additionally produces the percussive therapeutic effect along a longitudinal axis L1 of the attachment post 25 driven by the piston 20.

Figure 2A:
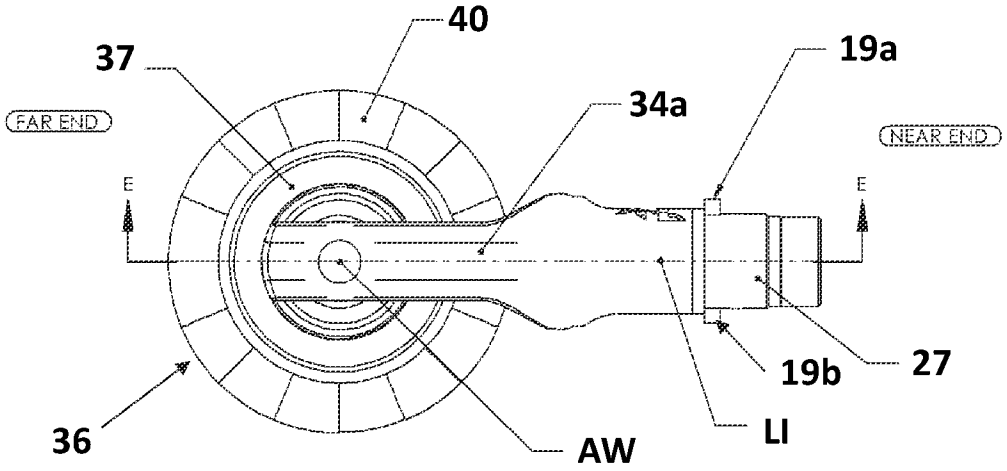
FIGS. 2*a*, 2*b*, 2*c* and 2*d* provide various views of a first tool of a massaging device according to one or more embodiments.

FIGS. 2*a*-2*d* provide additional views and details of the first exemplary tool 10. In FIG. 2*a*, a side view shows post 25, including keys 19*a* and 19*b* and push-fit elastomeric loop 27 located at a near end (i.e., proximal end) of the tool 10. At a far end (i.e., distal end) of the tool 10, a fork end 34*a* is shown as attached to wheel 36 at a first side 38*a* thereof. Wheel 36 freely rotates around wheel axis AW. Wheel 36 includes wheel reem 37 and skin-contacting surface 40.

Figure 2B:
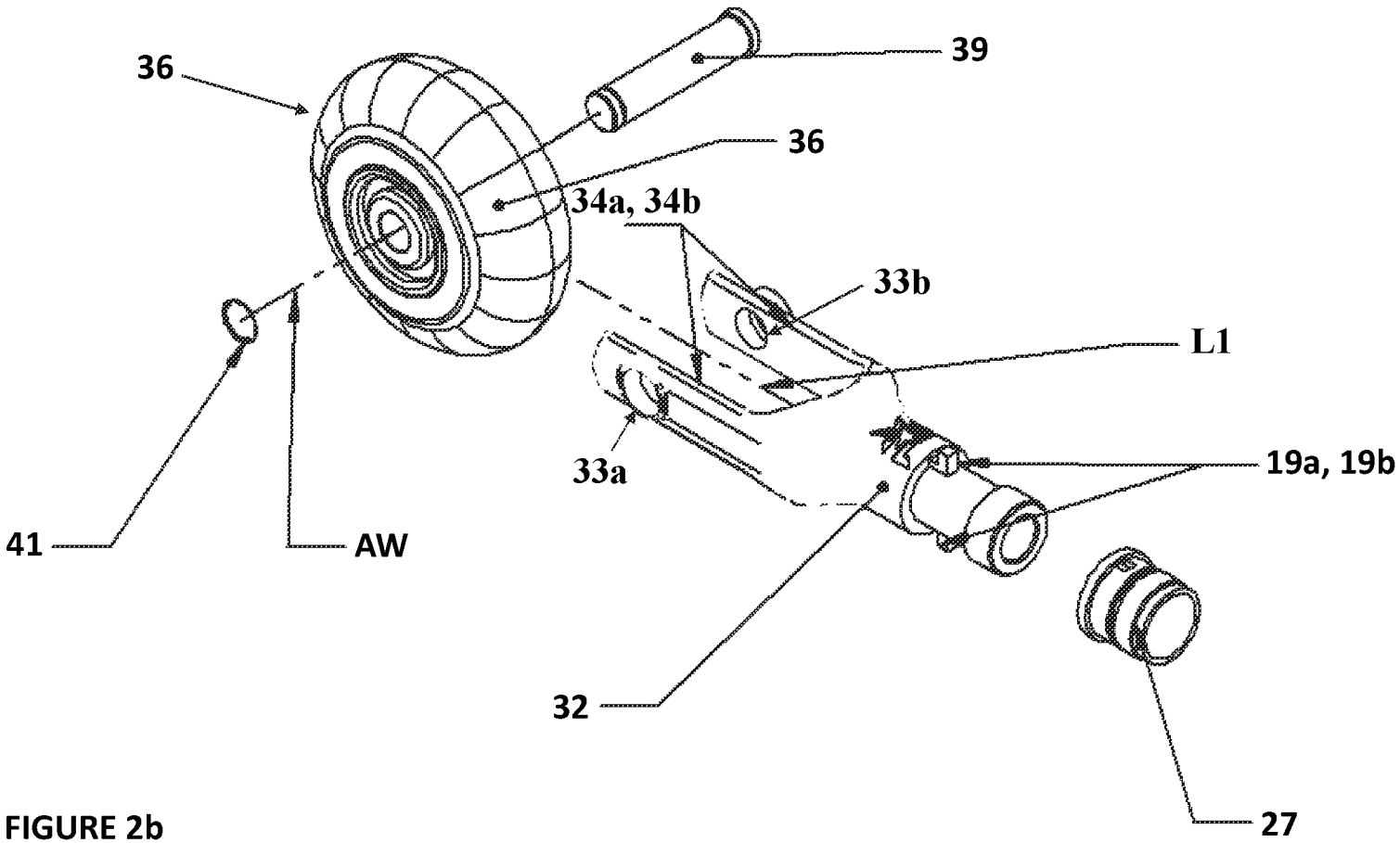

FIG. 2*b* is an exploded view of the first exemplary tool 10 as shown in FIG. 2*a*. In this view are illustrated: push-fit loop (or joint) 27, keys 19*a* and 19*b*, fork 32, both fork ends 34*a*, 34*b* with openings 33*a*, 33*b*, wheel 36, wheel shaft 39 for passing through openings 33*a*, 33*b* with and connecting with ring 41.

Figure 2D:
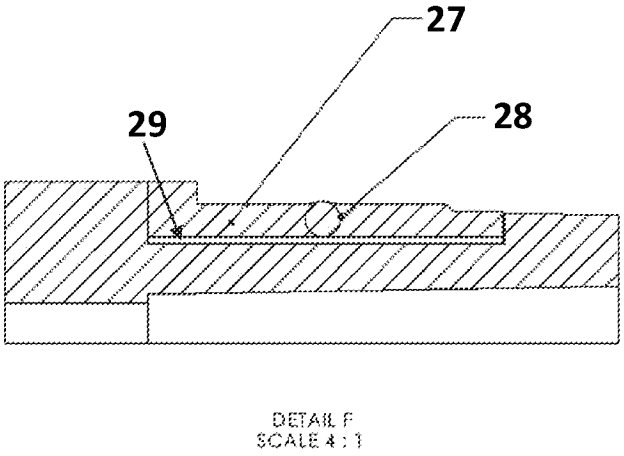
Figure 2C:
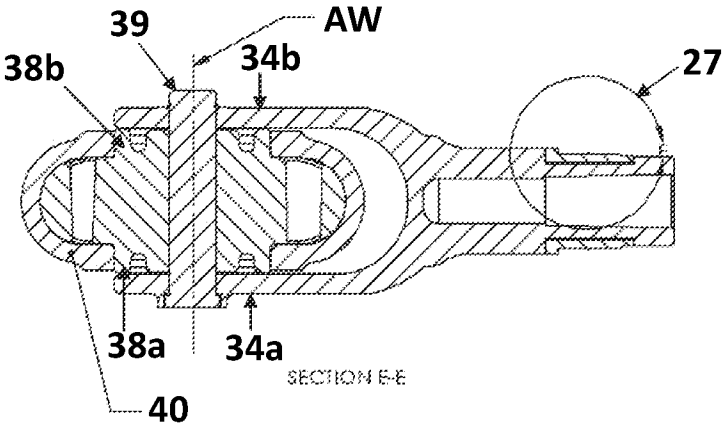

FIG. 2*c* shows section view E-E of FIG. 2*a*. In FIG. 2*d*, both fork ends 34*a*, 34*b* and both sides 38*a*, 38*b* of wheel 36 can be seen, as well as wheel shaft 39 which establishes wheel axis of rotation AW. FIG. 2*c* also illustrates push-fit elastomeric loop (or seal) 27, the details of which are further shown in the enlarged view thereof in FIG. 2*d*. In FIG. 2*d*, the push-fit elastomeric loop 27 is shown, wherein a small gap 29 is illustrated to accommodate the movement of the loop 27 when it is fitted within the tool receiver 15. In this embodiment, and additional fitting component 28 is embedded within the push-fit elastomeric loop 27 to further ensure the secure engagement of the attachment post 25 within the tool receiver 15. Fitting component 28 can be a toric shape.

Figure 3A:
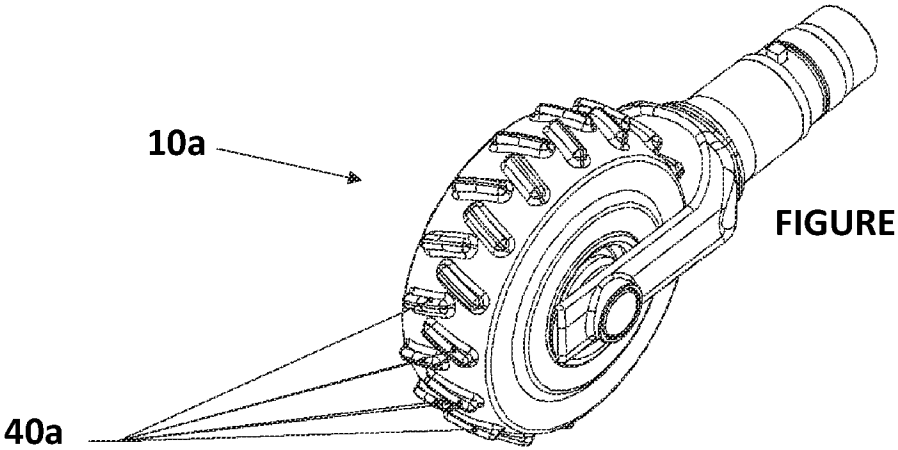
FIGS. 3*a*, 3*b* and 3*c* provide views of different tool head configurations of a first tool of a massaging device according to one or more embodiments.
Figure 3B:
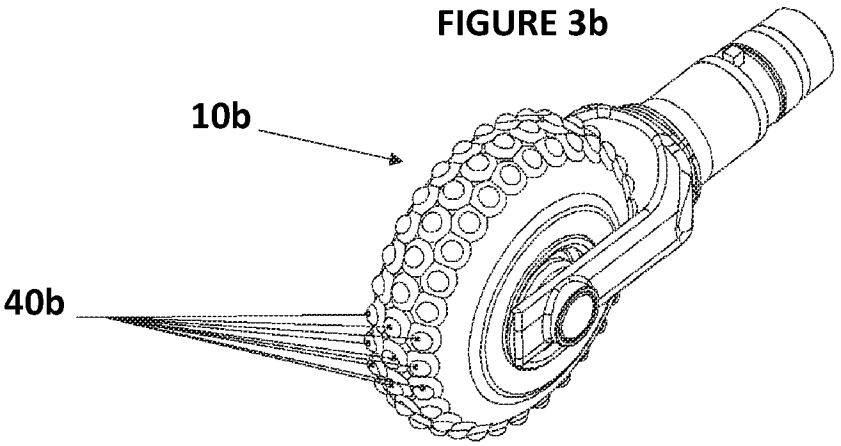
Figure 3C:
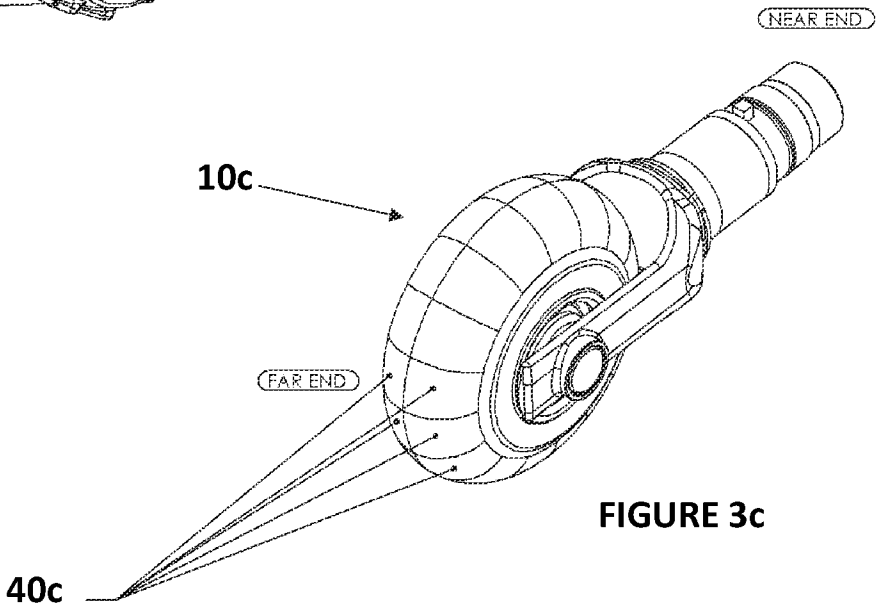

FIGS. 3*a*, 3*b* and 3*c* illustrate different exemplary tools 10*a*, 10*b*, 10*c*, wherein the only difference is in the configuration, e.g., texture, of the skin-contacting surface 40*a*, 40*b*, 40*c*. Different textures provide a different massaging experience for the user.

Figure 4A:
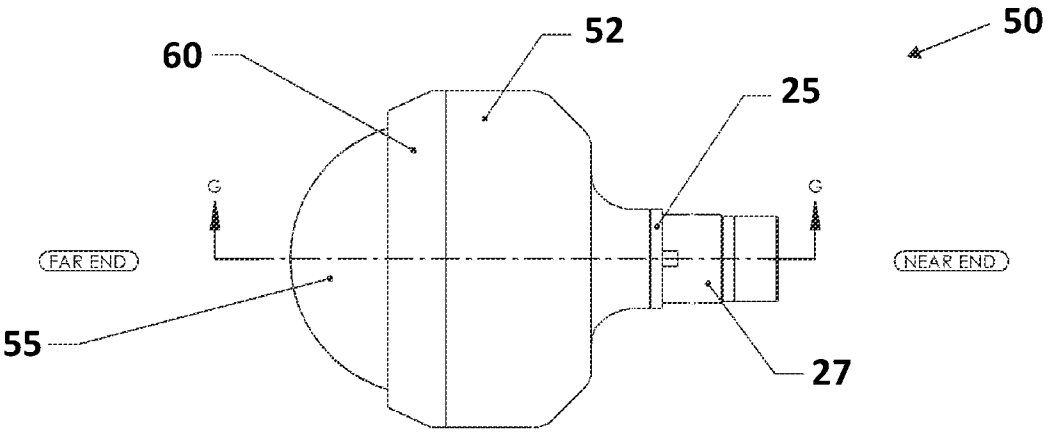
FIGS. 4*a*, 4*b* and 4*c* provide various views of a third tool of a massaging device according to one or more embodiments.
Figure 4B:
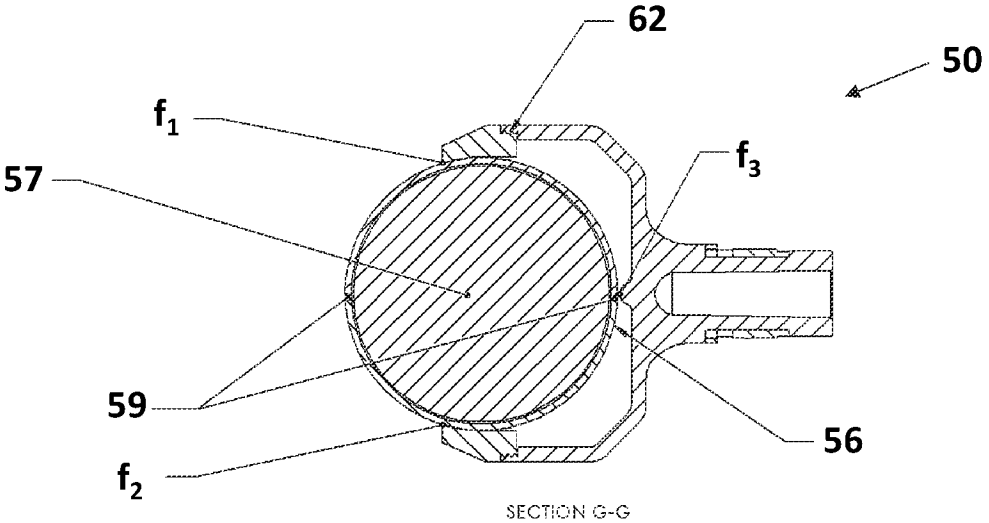
Figure 4C:
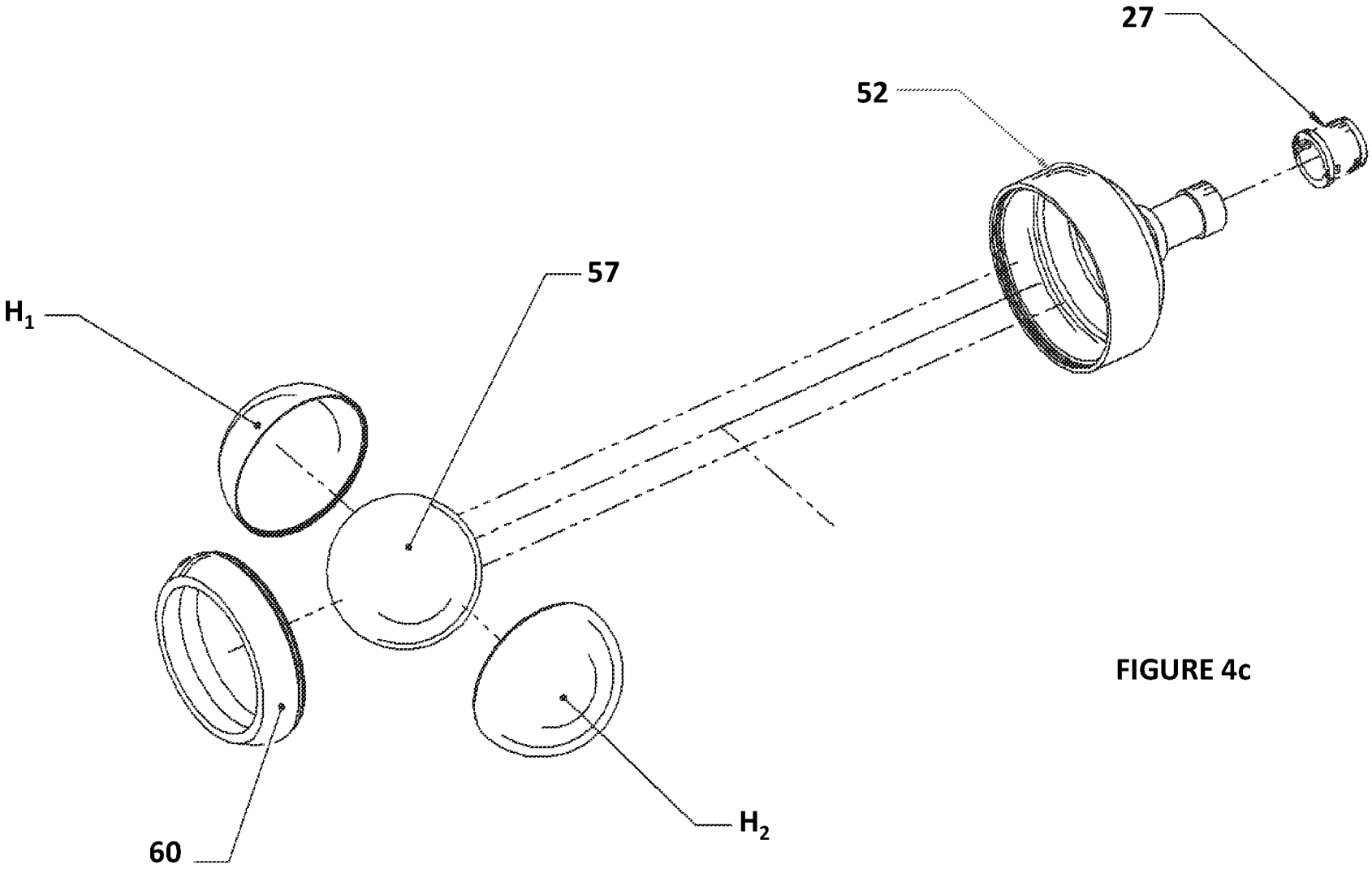

In FIGS. 4*a*, 4*b* and 4*c*, in of lieu of the wheel tool heads described above with respect to a first exemplary tool 10, a ball-type tool head 50 is fixed directly with the far end (distal end) of the attachment post 25. A spherical ball 55 is captured within a removable ring 60 of a cup base 52 and is rotationally free to rotate laterally as well as forward and backward. As such the spherical ball 55 is free to rotate along the person's skin while also producing the percussive therapeutic effect along the longitudinal axis L1 of the attachment post 25 (see FIG. 1). The remaining features discussed above with respect to the near end (proximal end) of the tool 10 are the same as the first embodiment with the wheel tool heads. FIG. 4*b* shows the section G-G view of FIG. 4*a*, which illustrates additional features of the ball-type tool head 50 including: friction points $f_1$, $f_2$ and $f_3$, including within the ring ($f_1$ and $f_2$) and at the back of the castor cup $f_3$ to provide some minimal friction when the spherical ball 55 rotates; ring threads 62 for threadedly attaching removable ring 60 to the cup 50; the removable two-part outer shell 56 of the spherical ball 55, wherein the two halves $H_1$ and $H_2$ are screwed together using threads 59 to encompass inner ball 57.

In an alternative configuration, one or more of the thread-based securing mechanisms are replaced by magnetic securing mechanisms at the same approximate locations of the threads.

As described in co-owned U.S. application Ser. No. 17/223,840 entitled Percussive Massager Rotational Accessory, which is incorporated herein by reference, spherical ball 55 may be a thermal and/or cooling element. The heat or cool generated by the cooling element produces a thermal or cooling effect through the two-part outer shell 56 to the person's skin.

Figure 5A:
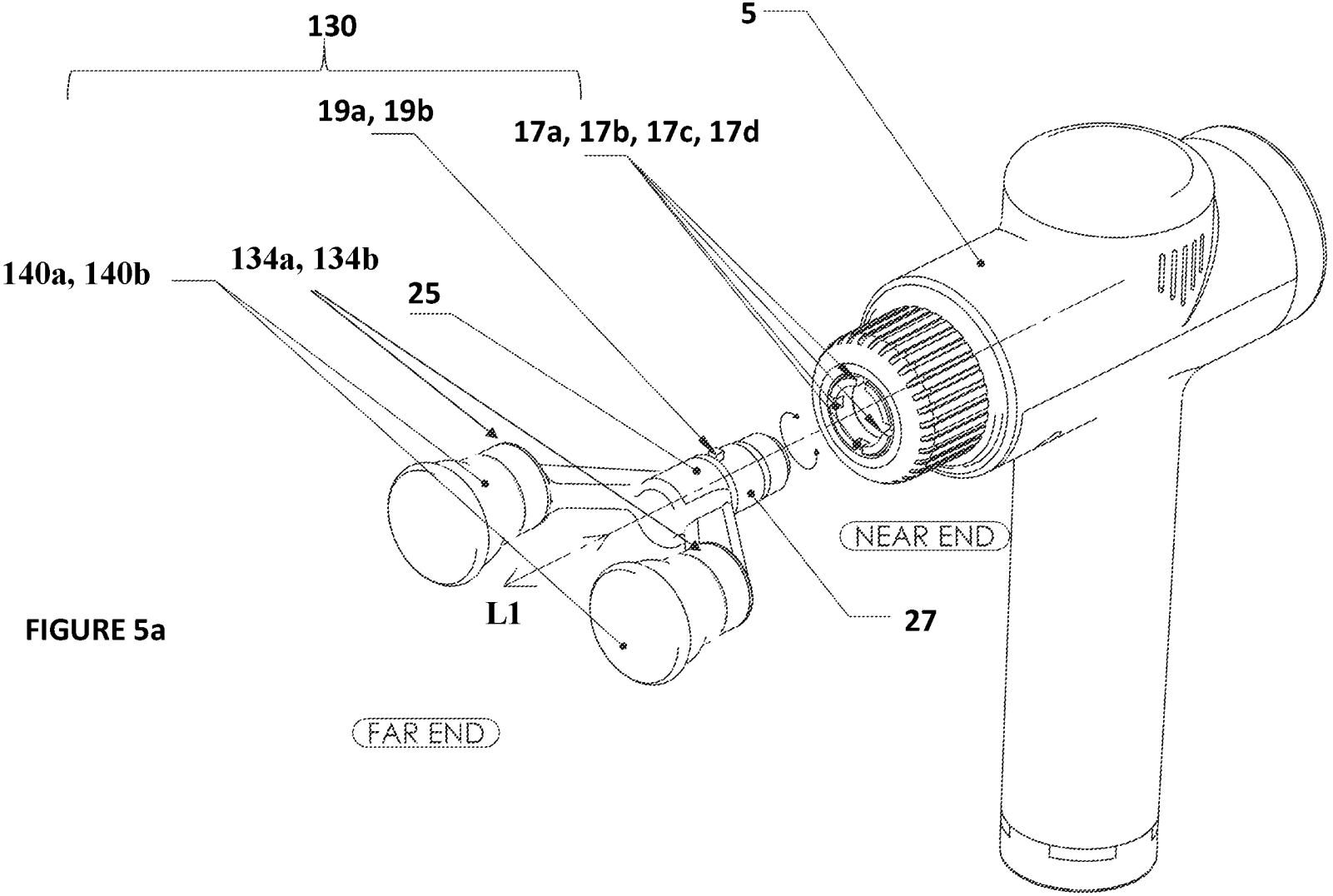
FIGS. 5*a* and 5*b* provide expanded views of a first and second exemplary configuration of a second tool and tool receiver of a massaging device according to one or more embodiments.
Figure 5B:
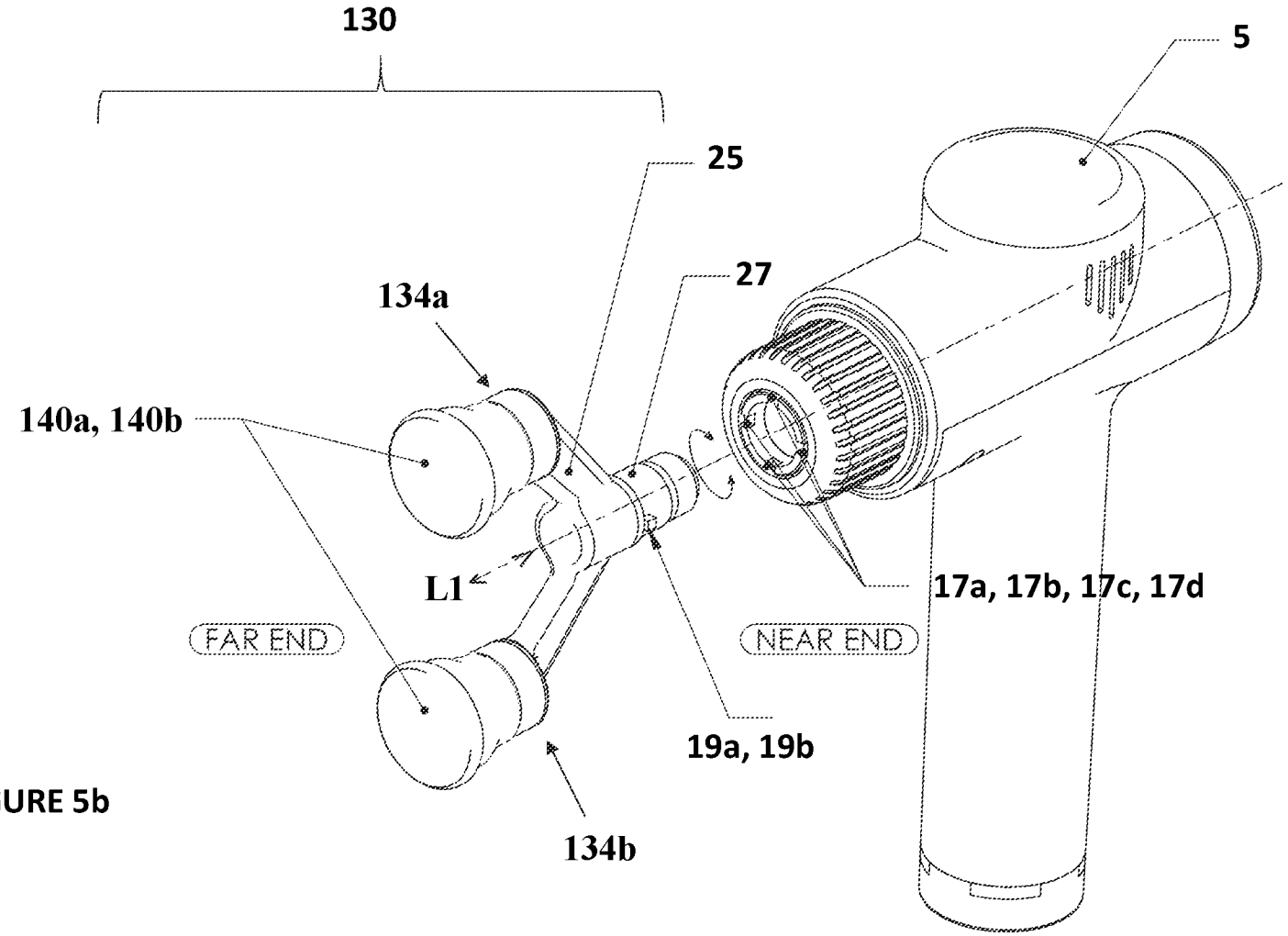

FIGS. 5*a* and 5*b* illustrates a third exemplary massage tool 10 for a percussive massaging device 5 that has a tool receiver 15. With the exception of the unique tool head 130, the remaining elements are identical to those of FIGS. 1*a* and 1*b*. The tool head 130 is rotatably fixed at a far end (e.g., distal end) of the attachment post 25 and has multiple skin-contacting surfaces 140*a* and 140*b*. More particularly, the tool head 130 includes a fork 132 fixed at a first end thereof to the attachment post 25 and terminates at two parallel fork ends 134*a*, 134*b* at a second end thereof. At the end of each fork end 134*a*, 134*b* is a skin-contacting surface 140*a* and 140*b* for providing a therapeutic effect along a longitudinal axis L1 of the attachment post 25 at two different points on the user's skin at the same time.

Figure 6A:
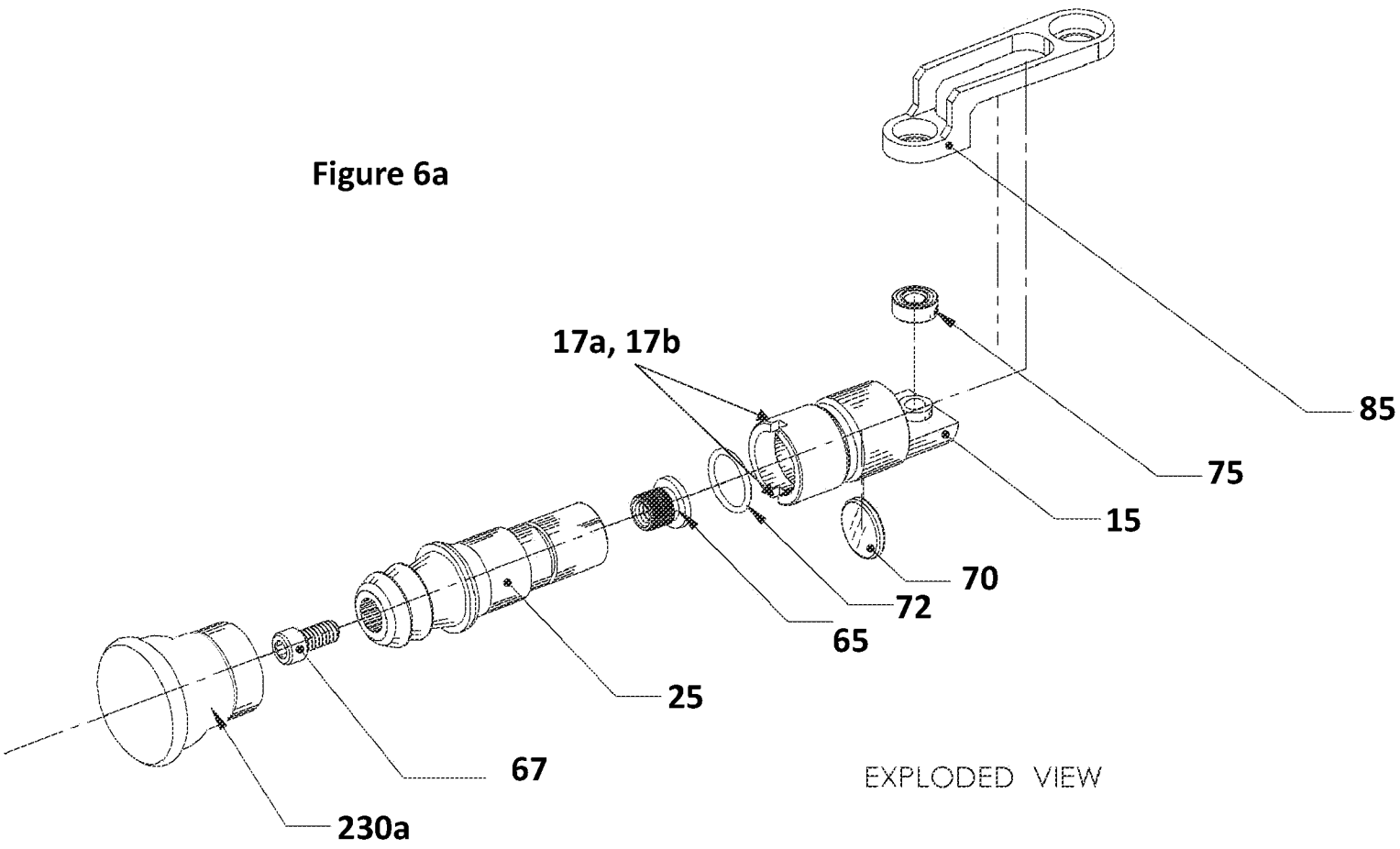
FIGS. 6*a*, 6*b*, 6*c* and 6*d* illustrate various views of a fourth tool of a massaging device having a magnetic attachment component and a first exchangeable tool head tip.
Figure 6B:
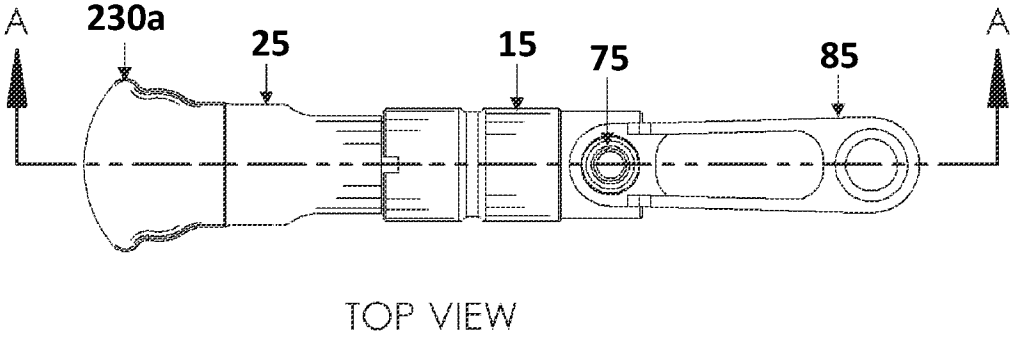
Figure 6C:
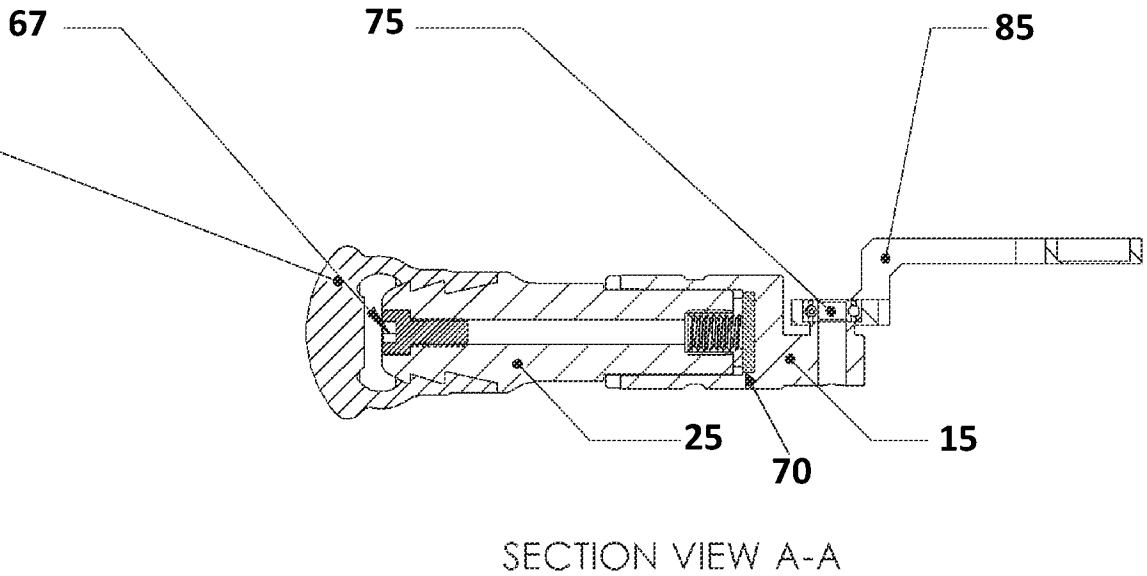
Figure 6D:
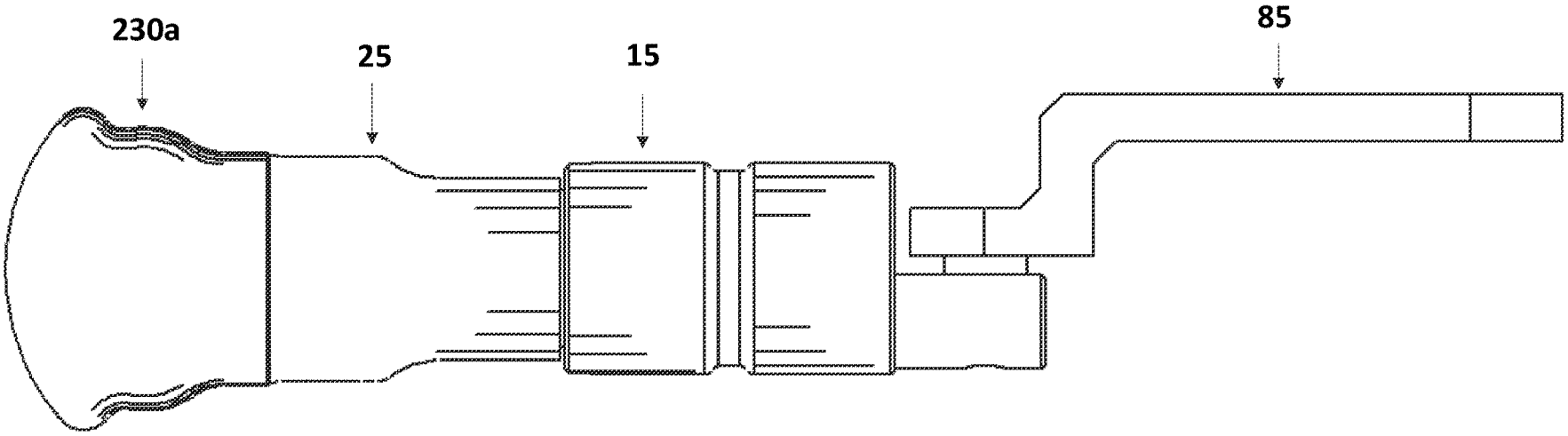

FIGS. 6*a*, 6*b*, 6*c* and 6*d* illustrate an alternative mechanism for attaching the attachment post or shaft 25 of a tool 10 to the tool receiver 15 of the massage device 5. Referring to FIG. 6*a*, the alternative mechanism is a magnetic attachment component wherein a shaft 25 of the tool 10, includes an insert 65 which is formed of a material that will be attracted to a magnet 70, located in the tool receiver 15 when brought into proximity thereof. An O-ring 72 is included to mitigate vibration between tool receiver 15 and shaft 25. Further, the tool head 230*a* of the present embodiment is a removable and exchangeable tip which includes a tip stiffener, e.g., fastener, e.g., screw, 67, which may be used to adjust impact for stiffness dampening during use of the massaging device (discussed below with respect to FIGS. 7*c*, 7*d*, 7*e*. Screw is fastened within the shaft of 25. The percussive motion imparted to the tool 10 is facilitated by connection of the tool receiver 15 to a crank 85 via bearing 75 located within the massage device 5. FIGS. 6*b*, 6*c* and 6*d* show additional views of the tool 10 with a particular tool head configuration 230*a*. FIGS. 7*a*, 7*b*, 7*c*, 7*d*, 7*e*, 8*a* and 8*b* illustrate view of tools 10 having different tool head configurations 230*b* (FIGS. 7*a*, 7*b*, 7*c*, 7*d*, 7*e*) and 230*c* FIGS. 8*a*, 8*b*).

Figure 7A:
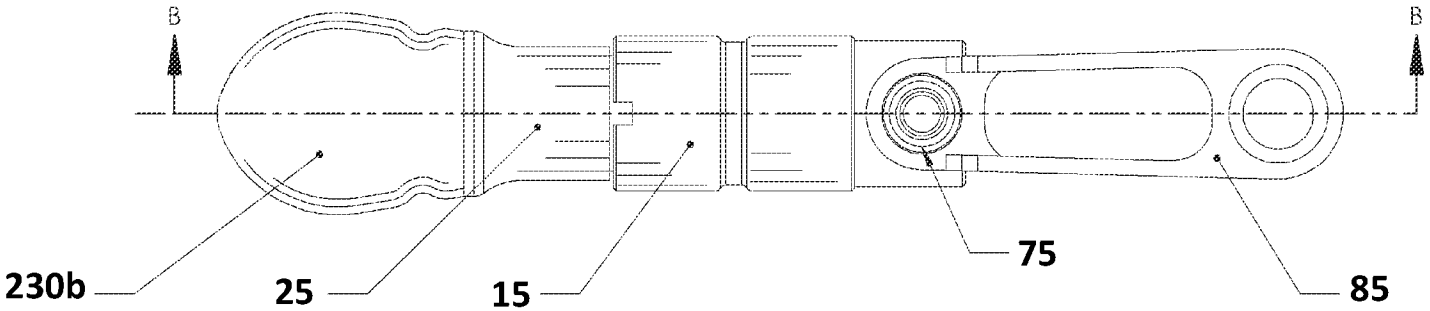
FIGS. 7*a*, 7*b*, 7*c*, 7*d* and 7*e* illustrate various views of a fourth tool of a massaging device having a magnetic attachment component and a second exchangeable tool head tip.
Figure 7B:
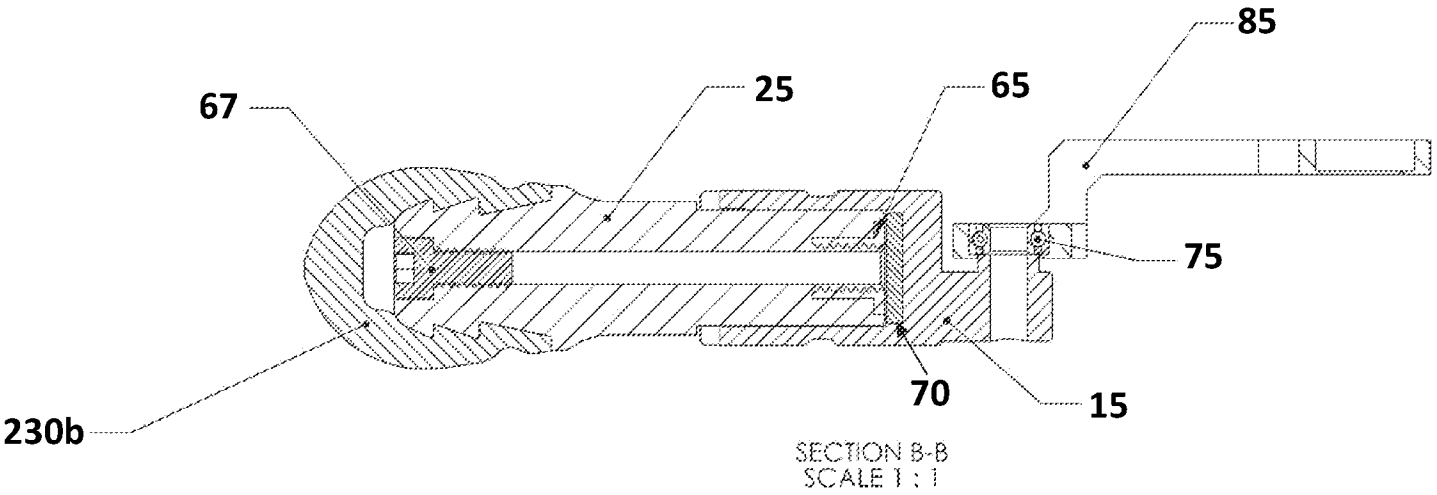
Figure 7D:
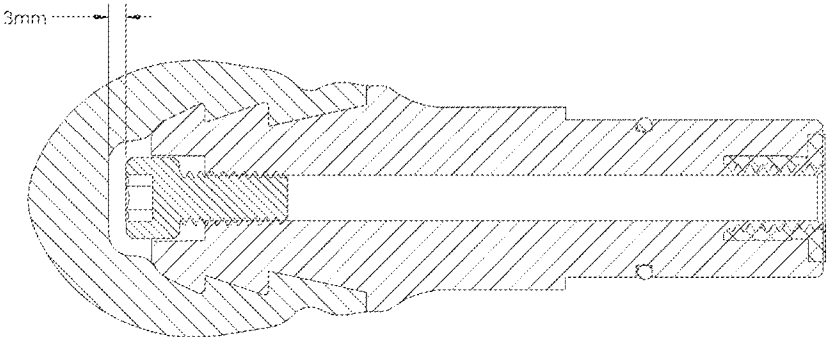
Figure 7C:
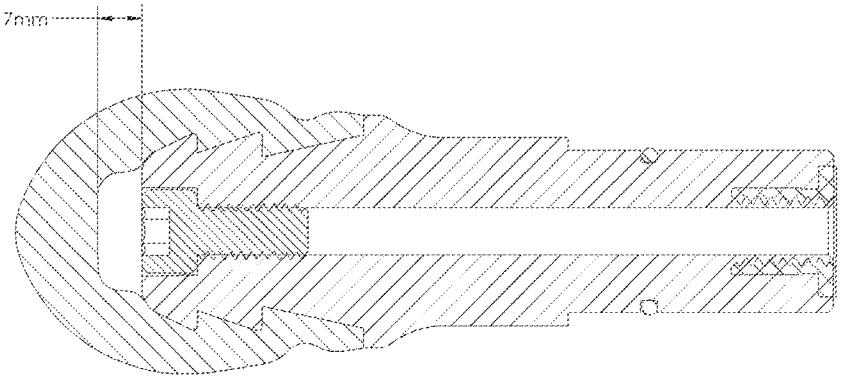
Figure 7E:
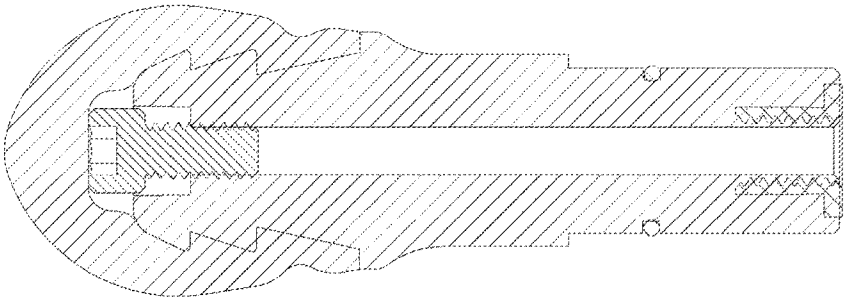
Figure 8A:
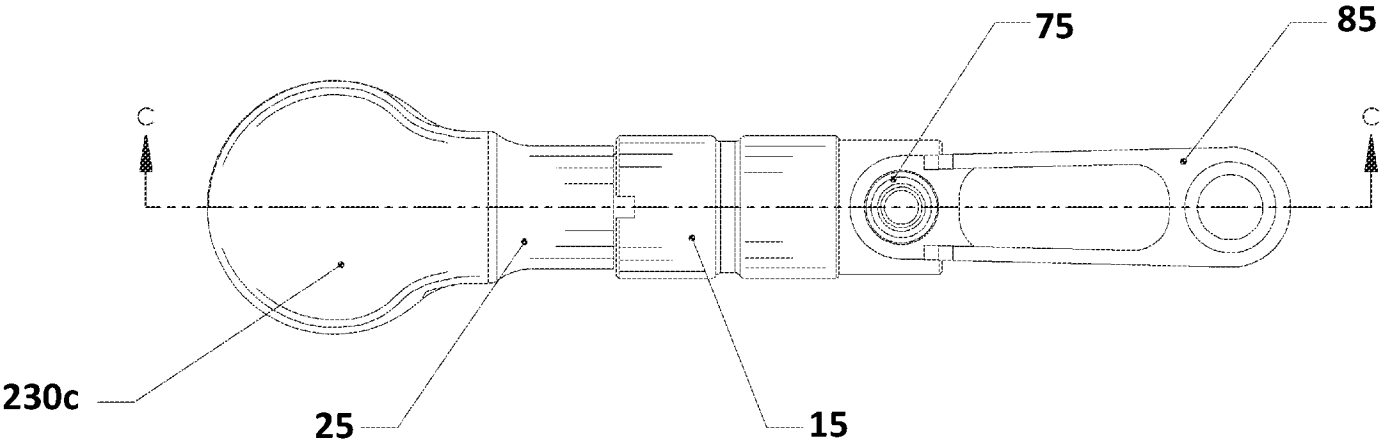
FIGS. 8*a* and 8*b* illustrate various views of a fourth tool of a massaging device having a magnetic attachment component and a third exchangeable tool head tip.
Figure 8B:
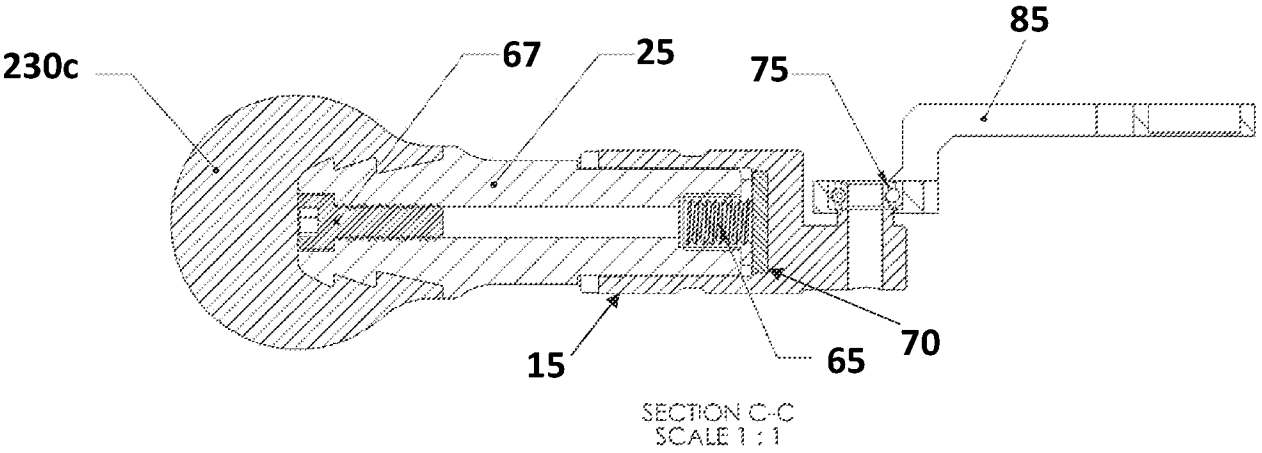

The screw 67 provides a user with the ability to adjust the hardness of the tool heads. More particularly, referring to FIGS. 7*c*, 7*d* and 7*e*, by adjusting the screw 67, the width of gap G between the screw head and the tip of the tool head 230*b* can be increased or decreased, which results in a change in the hardness of the elastomeric tip of the tool head 230*b*. FIG. 7*c* shows a gap of 7 mm, FIG. 7*d* shows a gap of 3 mm and FIG. 7*e* shows no gap. As such, given a percussion travel distance of 14 mm, having an air gap to act as a shock for the percussion massager tip 230*b* at half the size of the travel distance (7 mm as shown in FIG. 7*c*), results in an extra tap or an extended stroke via the reverberation when the elastomer meets the shaft 25 under action. This is a reverberation impact (or an echolike effect) which means that when the massager device motor (not shown) rotates at 23,000 rpm, the tip will provide 46,000 taps/strokes to the soft tissue when the screw is tightened up to stiffen the impact. Whereas, if the head of the screw 67 is unscrewed by (7 mm), thus closing the gap to 0 (FIG. 7*e*), the device provides 23,000 "stiffer" taps.

Although the embodiments show the magnet 70 as a solid disc, the embodiments need not be so limited. The magnet could be in the form of a ring. Further the magnet may be formed in a process whereby it is embedded in the tool holder material as part of a molding or similar process as would be known to those skilled in the art.

Additionally, though not shown, the attachment post or shaft 25 in the magnetic mechanism embodiments may also include keys (not shown, but described in prior embodiments) to engage with keyways, e.g., 17*a*, 17*b*, of the tool receiver 15 shown in, e.g., FIG. 6*a* et seq. Accordingly, the alternative magnetic attachment mechanism may be used in lieu of the key and keyway configuration shown in FIG. 1*a* et seq. or in addition thereto as an alternative to the push-fit seal.

Figure 9A:
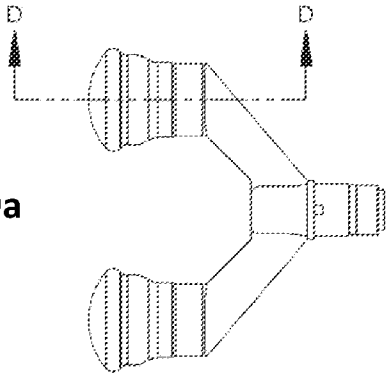
FIGS. 9*a*, 9*b* and 9*c* illustrate various views of a fifth tool of a massaging device having a magnetic attachment component and multiple, independently exchangeable tool head tips.
Figure 9B:
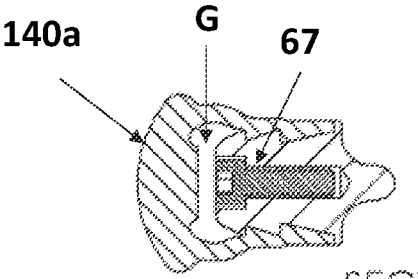
Figure 9C:
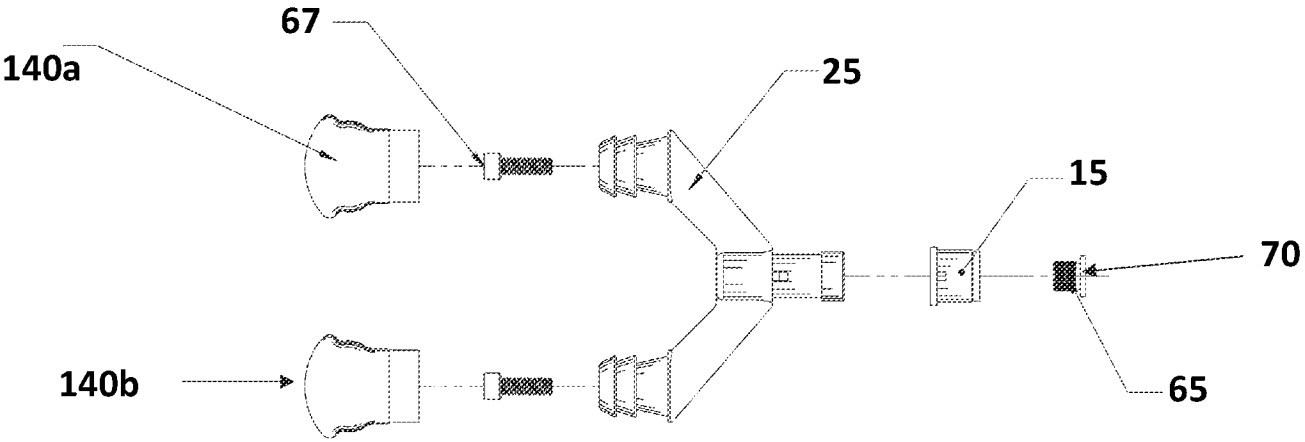

FIGS. 9*a*, 9*b* and 9*c* illustrate yet another embodiment which utilizes the unique tool head 130, which has multiple skin-contacting surfaces 140*a* and 140*b* at first ends thereof and at a second end thereof is attached to shaft 25, which is attached to tool receiver 15 using the magnetic mechanism described above. Additionally, each of the multiple skin-contacting surfaces 140*a* and 140*b* is an independent exchangeable tip which may also be adjusted for hardness as described above with respect to FIGS. 7*c*, 7*d* and 7*e*.

While a particular embodiments have been illustrated and described, it will be apparent that various modifications can be made without departing from the spirit and scope thereof.

Particular terminology used when describing certain features or aspects of the embodiments should not be taken to imply that the terminology is being redefined herein to be restricted to any specific characteristics, features, or aspects which that terminology is associated. In general, the terms used in the following claims should not be construed to limit the specific embodiments disclosed in the specification, unless the above Detailed Description section explicitly defines such terms. Accordingly, the actual scope of the embodiments encompasses not only what is disclosed, but also all equivalents thereof.

The above detailed description of the embodiments is not intended to be exhaustive or to limited to the precise form disclosed above or to the particular field of usage mentioned in this disclosure. While specific embodiments of, and examples are described above for illustrative purposes, various equivalent modifications are possible within the scope of the embodiments, as those skilled in the relevant art will recognize. Also, the teachings provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the embodiments can be modified, if necessary, to employ the systems, functions, and concepts of the various references described above to provide yet further embodiments.

The invention claimed is:

1. A percussive massaging device, comprising:

a tool receiver for receiving a massage tool therein, the tool receiver including a piston for providing percussive action to the massage tool; and the massage tool, including a hollow attachment post at a first end thereof for insertion into the tool receiver and selectively attaching to the tool receiver and engaging with the piston, wherein the tool receiver includes multiple keyways and the hollow attachment post includes multiple keys for engaging with at least some of the keyways to secure the massage tool to the tool receiver and engage with the piston to facilitate the piston providing percussive action along a longitudinal axis of the hollow attachment post, and further wherein the massage tool, including hollow attachment post, is removable from the tool receiver;

the massage tool further including at least one interchangeable tool head tip attached to at least one second end of the hollow attachment post, the at least one interchangeable tool head tip being removable from the massage tool, wherein the massage tool includes an adjustment means for adjusting a hardness of each at least one interchangeable tool head tip.

2. The percussive massaging device of claim 1, further including an additional attachment mechanism for further securing the hollow attachment post to the tool receiver.

3. The percussive massaging device of claim 2, wherein the additional attachment mechanism is a press-fit seal.

4. The percussive massaging device of claim 3, wherein the press-fit seal is elastomeric.

5. The percussive massaging device of claim 4, wherein the press-fit seal further includes a fitting component embedded therein.

6. The percussive massaging device of claim 5, wherein the fitting component has a toric shape.

7. The percussive massaging device of claim 2, wherein the additional attachment mechanism is a magnetic component.

8. The percussive massaging device of claim 7, wherein the magnetic component includes a magnet located in the tool receiver and an insert formed of magnetically attracted material located on the hollow attachment post.

9. The percussive massaging device of claim 1, wherein the massage tool further includes a tool head selected from the group consisting of a non-rotatable tip tool head and a rotatable tip tool head capable of being rotated to re-orient the tip.

10. The percussive massaging device of claim 9, wherein the tool head includes a wheel which is mounted between opposing fork ends of the hollow attachment post.

11. The percussive massaging device of claim 9, wherein the tool receiver includes four keyways and the hollow attachment post includes two keys.

12. The percussive massaging device of claim 11, wherein the tool receiver is approximately circular in shape and the four keyways are located at approximately 3, 6, 9 and 12 o-clock around the perimeter of the tool receiver.

13. The percussive massaging device of claim 11, wherein the hollow attachment post is approximately circular in shape and the two keys are located on diametrically opposite sides of a perimeter of the hollow attachment post.

14. The percussive massaging device of claim 13, wherein the tool head is aligned in one of a vertical and horizontal alignment in accordance with alignment of the two keys with a first and second pair of keyways.

15. The percussive massaging device of claim 9, wherein the tool head includes a sphere which is rotatably mounted within a cup base, the cup base being mounted to the hollow attachment post.

16. The percussive massaging device of claim 15, wherein the tool head further includes a removable ring connected to the cup base for further securing the rotatably mounted sphere.

17. A percussive massaging device, comprising:

a tool receiver for receiving a massage tool therein, the tool receiver including a piston for providing percussive action to the massage tool; and the massage tool, including a hollow attachment post at a first end thereof for insertion into the tool receiver and engaging with the piston to facilitate the piston providing percussive action along a longitudinal axis of the hollow attachment post, the hollow attachment post selectively attaching to the tool receiver via a magnetic mechanism, wherein the magnetic mechanism includes a magnet located in the tool receiver and an insert formed of magnetically attracted material located on the hollow attachment post;

the massage tool further comprising at least one interchangeable tool head tip attached to at least one second end of the hollow attachment post, the at least one interchangeable tool head tip being removable from the massage tool, wherein the massage tool includes an adjustment means for adjusting a hardness of each at least one interchangeable tool head tip.

18. The percussive massaging device of claim 17, wherein the magnet is in a shape of a ring.

19. A percussive massaging device, comprising:

a tool receiver for receiving a massage tool therein, the tool receiver including a piston for providing percussive action to the massage tool; and the massage tool, including a hollow attachment post at a first end thereof for insertion into the tool receiver and selectively attaching to the tool receiver via a magnetic mechanism, wherein the magnetic mechanism includes a magnet located in the tool receiver and an insert formed of magnetically attracted material located on the hollow attachment post;

the massage tool further comprising at least one interchangeable tool head tip attached to at least one second end of the hollow attachment post, the at least one interchangeable tool head tip being removable from the massage tool and an adjustment means for adjusting a hardness of each at least one interchangeable tool head tip.

* * * * *